United States Patent [19]

Huntsinger

[11] 4,065,831

[45] Jan. 3, 1978

[54] STOP MOTION FOR DRAWING FRAMES

[76] Inventor: Arnold G. Huntsinger, 604 E. Georgia Ave., Bessemer City, N.C. 28016

[21] Appl. No.: 696,179

[22] Filed: June 15, 1976

[51] Int. Cl.[2] ..... D01G 31/00

[52] U.S. Cl. ..... 19/.25

[58] Field of Search ..... 19/.2–.26, 19/150, 157, 144.5, 236; 57/50; 226/11

[56] References Cited

U.S. PATENT DOCUMENTS

| | | | |
|---|---|---|---|
| 1,117,721 | 11/1914 | Straw | 19/157 |
| 1,727,764 | 9/1929 | Gibbs | 19/157 |
| 2,613,400 | 10/1952 | Riordan et al. | 19/144.5 |
| 3,345,695 | 10/1967 | Rayfield et al. | 19/.25 |
| 3,358,432 | 12/1967 | Croxton | 57/50 |
| 3,363,285 | 1/1968 | Foster | 19/.25 |
| 3,445,894 | 5/1969 | Rayfield et al. | 19/.25 |

FOREIGN PATENT DOCUMENTS

| | | | |
|---|---|---|---|
| 6,092 of | 1900 | United Kingdom | 19/.25 |

OTHER PUBLICATIONS

Saco- Lowell Bulletin - July 1953, pp. 16 & 17.

*Primary Examiner*—Dorsey Newton
*Attorney, Agent, or Firm*—Clifton T. Hunt, Jr.

[57] ABSTRACT

A pivoted stop motion particularly adapted for each of a plurality of ends of sliver or the like is operatively associated with a rotatable guide for sliver having little tensile strength to stop the drawing frame if an end of sliver breaks or becomes slack. An electrically charged contact rod extends over a row of pivoted sensors perpendicularly to the path of the sliver, the several ends of which are separated from each other by discs fixed to a rotatable shaft. Breakage of an end of sliver causes its corresponding sensor to engage the contact rod to stop the machine.

1 Claim, 4 Drawing Figures

STOP MOTION FOR DRAWING FRAMES

BACKGROUND OF THE INVENTION

Stop motions for roving frames have long been known. See, for example, U.S. Pat. No. 3,363,285 to Foster. Foster discloses the use of a control rod 30 extending above a row of sensors or detector fingers, each of which is normally supported by a strand or end of sliver but which is movable upon the strand breaking or becoming slack to cause its associated contact finger to engage the control rod and complete a circuit to stop the machine. The Foster apparatus is mounted on a creel arm which is stationary and over which the sliver is drawn in its path from the supply cans to the drafting rolls. The use of the Foster stop motion on a stationary guide in the form of a creel has proven objectionable in the processing of sliver with little tensile strength. Such sliver tends to break easily when subjected to the friction imposed by being drawn over a stationary bar and beneath the sensors.

SUMMARY OF THE INVENTION

In the present invention, the spoons or sensors are closely associated with a rotatable guide including a support rod extending perpendicularly of the path of the sliver and on which are journaled tubular guides and a plurality of spaced discs which are mounted for rotation with the tubular guides and spaced axially along the support rod. A single end of sliver extends beneath a tubular guide and between two adjacent discs so that the discs separate the ends of sliver from each other and prevent the frictional abrasion which would result from the strands contacting each other.

As the drafting rolls draw the sliver from the supply cans, the tubular guides are adapted to be rotated by the movement of the sliver as it is drawn beneath the tubular guides to reduce to a minimum the friction on the sliver. Toward this end the tubular guides are mounted in roller bearings on the support rod. The sliver passes from beneath its tubular guide to sensors extending from the support rod toward the drafting rolls and in the path of the sliver so that corresponding sensors lightly ride on the sliver in normal operation. The control rod which in engaged to stop the machine when a strand breaks is positioned above the path of the sliver to avoid as much as possible contamination by dust and lint.

With an apparatus of the type described, sliver with little tensile strength and which does not hold together well may be fed to the drafting rolls with a minimum of breakage and with reliable stopping of the machine if breakage does occur.

DETAILED DESCRIPTION OF THE INVENTION

Figure 1:
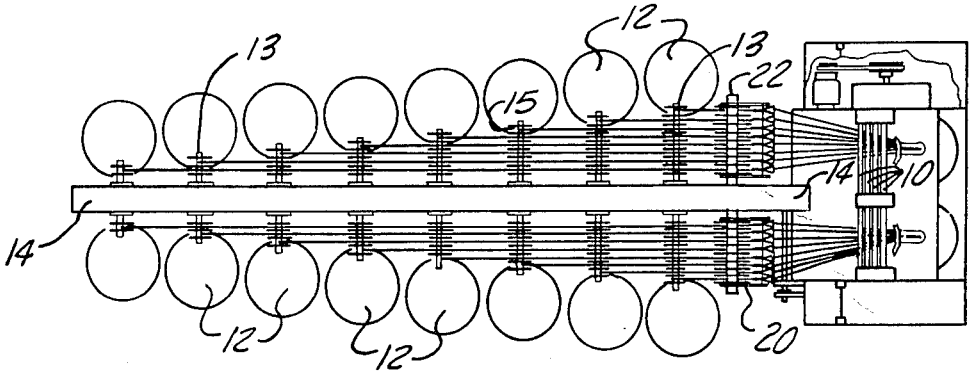
FIG. 1 is a plan view of a drawing frame and its supply cans with a strand feeding creel and illustrating the location of the stop motion of this invention with respect thereto.

The drawing frame includes a set of upper drafting rolls 10 and lower drafting rolls 11 which define a drafting zone through which strands or end of sliver S are passed. The strands S are withdrawn from supply cans 12 arranged behind the drawing frame as shown in FIG. 1. The strands S are withdrawn from the supply cans 12 and pass upwardly and over creel arms 13 which extend laterally from opposite sides of a central longitudinally extending creel frame 14. The creel arms 13 each include a plurality of spaced apart strand guiding passageways 15 through which the individual strands S are drawn. The passageways 15 each preferably includes a freely rotatable or driven lifter roll journaled on its creel arm 13 to minimize the friction on the strands. See, for example, U.S. Pat. No. 3,337,923 to J. R. Whitehurst.

In accordance with the present invention, a stop motion device broadly indicated at 20 depends from the end portion of the longitudinal creel frame 14 nearest the drafting rolls 10 and 11 and is rigidly attached thereto by arm 21. The lower end of arm 21 is fixed to a support rod 22 extending perpendicularly to arm 21 and perpendicularly to the path of travel of the strands S from the cans 12 to the drafting rolls 10, 11. The lower end of arm 21 is joined to the medial portion of support rod 22. Rod 22 may be of any desired length but is generally of sufficient length to accommodate the mechanism for guiding eight strands S on each side of creel frame 14 to the drafting rolls 10, 11.

A rotatable tubular guide 23 is journaled on support rod 22 on each side of creel frame 14. Each tubular guide 23 is mounted for rotation on ball bearings 18 carried by support rod 22 adjacent its ends and on opposite sides of arm 21. A plurality of disc guides 24 are spaced along each tubular guide 23 and rotatable therewith responsive to movement of the strands S from the supply cans 12 to the drafting rolls.

Figure 3:
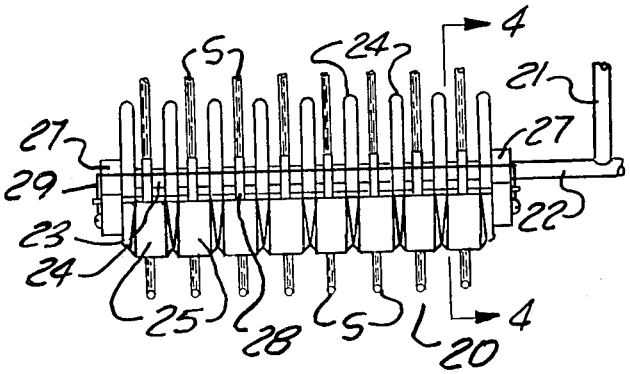
FIG. 3 is a fragmentary plan view showing that portion of the stop motion with its associated strands on one side of the creel frame.

In the illustrated embodiment there are 16 strands S passing from the supply cans 12 to the drafting rolls 10 and 11, eight strands on one side of the creel frame 14 and eight strands on the other side of creel frame 14. (FIG. 1). Thus, in the illustrated embodiment, the support rod 22 which is fixed to the creel frame 14 by centrally disposed rod 21 has a rotatable tubular guide 23 and nine disc guides 24 on each side of creel frame 14. (FIG. 3).

Figure 2:
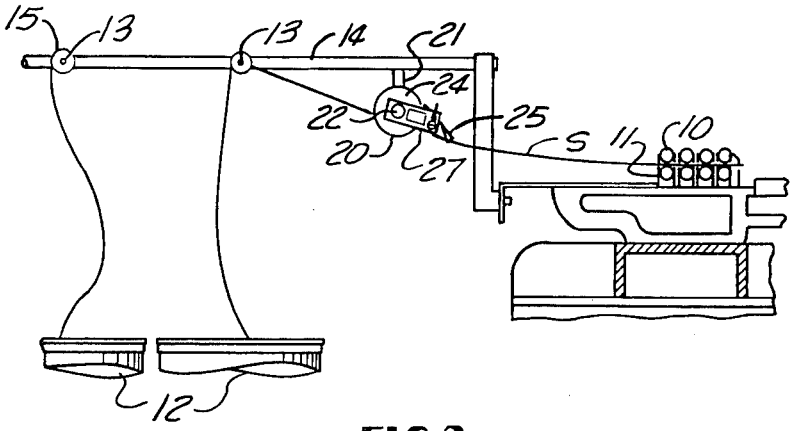
FIG. 2 is a fragmentary elevation, partially in section, of a portion of the drawing frame and the stop motion supported between it and the supply cans.
Figure 4:
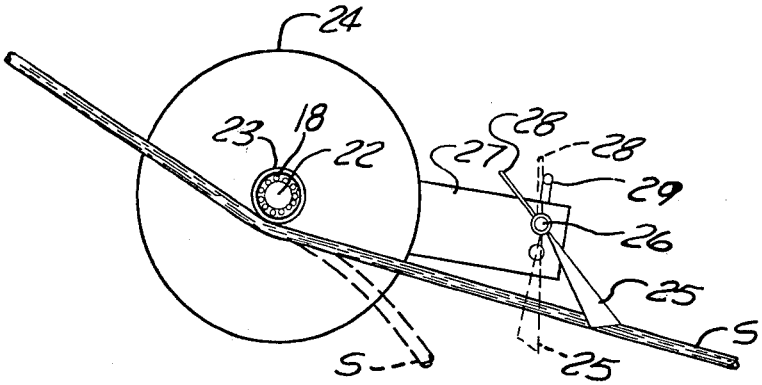
FIG. 4 is a vertical sectional view taken substantially along the line 4—4 in FIG. 3.

As most clearly seen in FIGS. 2 and 4, the strands S are fed from the proximate strand guiding passageway 15 on its creel arm 13 to the stop motion 20 where the strands are isolated from each other by the disc guides 24 and each strand is fed beneath one of the tubular guides 23 on its way to drafting rolls 10, 11. The tubular guides 23 thus provide the dual function of serving as a leveler bar to properly orient the strands for delivery to the drafting rolls, and as means for delivering the strands to spoons 25 pivotally supported on a shaft 26 extending in closely spaced parallel relation to support rod 22 and between arms 27 carried by support shaft 22 and extending toward the drafting rolls 10 and 11. The longitudinal axis of the shaft 26 on which spoons 25 are pivotally supported lies in a plane beneath the plane of the longitudinal axis of support shaft 22 (FIGS. 2 and 4). The spoons 25 each include a contact element 28 extending beyond the pivot shaft 26 in opposite direction from its spoon 25. The contact element 28 is properly dimensioned to provide an effective counterweight to the spoon 25 to minimize the frictional resistance of the spoon 25 to the passage of strand S therebeneath.

In the event of breakage of a strand S, its corresponding spoon 25 moves from the solid line position to the dotted line position in FIG. 4, causing corresponding movement of its contact element 28 in an upward direction to the dotted line position in FIG. 4 where it engages an electrically charged control rod 29 extending between the arms 27 and coextensive with the pivot shaft 26. The control rod 29 is suitably connected in any conventional manner to an electrical stop motion circuit, not shown.

Thus, upon the breakage of any strand S its corresponding spoon 25 will deflect to the dotted line position in FIG. 4 and elevate the contact tail 28 to the dotted line position of FIG. 4 where it engages control rod 29 and completes a circuit to stop the machine.

There is thus provided an improved stop motion particularly adapted for use with sliver which is fragile and easily broken in its passage from the supply cans to the draftng rolls. The tubular guides 23 reduce to a minimum the friction on the strands and the disc guides 24 effectively separate the strands to prevent abrasion while the contact tail 28 effectively balances the weight of the spoon 25 to further minimize friction on the strands. Even so, it is recognized that breakage will still occur, although with significantly less frequency than in the prior art apparatus, and in that event the elevated control rod 29 which is maintained relatively free of lint by being positioned above the path of the strands will reliably send a message to the drive of the draw frame when engaged by the contact tail 28 to stop the machine so the broken strand can be pieced.

I claim:

1. In a drawing frame having upper and lower drafting rolls and a creel for guiding a plurality of strands of sliver from supply cans to the drafting rolls, said creel including a longitudinal frame, a plurality of creel arms extending transversely above the supply cans, and a strand guiding passageway above each supply can and carried by one of said creel arms, the combination of a stop motion supported by said creel frame between the proximate supply cans and the upper and lower drafting rolls, said stop motion including a freely rotatable tubular guide beneath which a plurality of strands are directed in their passage from the supply cans to the drafing rolls, said tubular guide being positioned in the path of said strands and functioning as a leveler bar to displace the strands downwardly from their direct path between the proximate transverse creel arm and the drafting rolls, said tubular guide being freely rotatable in response to movement of the sliver therebeneath as it moves from the supply cans to the drafting rolls, a plurality of disc guides carried by said tubular guide in spaced relation to each other and said disc guides being alternately spaced with said strands along the longitudinal axis of the tubular guide so that the disc guides space the strands from each other and prevent abrasion, means responsive to breakage of one of said strands to stop the drafting rolls, said tubular guide being journaled on a support rod depending from the creel frame and extending in perpendicular relation to the path of the strands from the supply cans to the drafting rolls, a pair of arms extending in parallel relation to each other downwardly from the ends of the support rod toward the drafting rolls, said means for stopping the drawing frame in the event of strand breakage being carried by said arms, said means for stopping the drawing frame including a pivot shaft extending between said arms, a plurality of detectors pivotally mounted on said shaft and arranged in spaced relation to each other along said shaft, there being one detector for each strand and arranged in overlying relation to its respective strand extending from between adjacent disc guides, each detector including a spoon overlying and normally resting on its respective strand during normal operation, a contact tail extending from the spoon and projecting beyond the pivot shaft in the opposite direction from the spoon and serving as a counterweight, and a control bar extending between said arms in spaced parallel relation to said pivot shaft and positioned above the pivot shaft whereby downward movement of a spoon in response to breakage of a strand causes corresponding upward movement of the contact tail to engage the control bar and complete a circuit to stop the drawing frame.

* * * * *